United States Patent [19]

Trullás

[11] 4,143,527

[45] Mar. 13, 1979

[54] APPARATUS FOR THE WET TREATMENT OF FABRICS

[75] Inventor: Isidro F. Trullás, Tarrasa, Spain

[73] Assignee: Argelich, Termes Y Cia., S.A., Tarrasa, Spain

[21] Appl. No.: 855,135

[22] Filed: Nov. 28, 1977

[30] Foreign Application Priority Data

Apr. 28, 1977 [ES] Spain ..... 458.257

[51] Int. Cl.[2] ..... D06B 3/28

[52] U.S. Cl. ..... 68/18 F; 68/178

[58] Field of Search ..... 68/18 F, 177, 178, 184

[56] References Cited

U.S. PATENT DOCUMENTS

| | | | |
|---|---|---|---|
| 2,023,013 | 12/1935 | Faber et al. | 68/18 F X |
| 3,762,189 | 10/1973 | Marsh et al. | 68/177 |
| 3,911,702 | 10/1975 | Eckrodt | 68/177 |
| 3,924,424 | 12/1975 | Watanabe et al. | 68/177 |
| 3,949,575 | 4/1976 | Turner et al. | 68/178 X |

*Primary Examiner*—Philip R. Coe

*Attorney, Agent, or Firm*—Sughrue, Rothwell, Mion, Zinn and Macpeak

[57] ABSTRACT

Apparatus for the wet treatment of fabrics in rope form, wherein the tubular storage chamber is curved according to an arc of a circle in the vertical plane and has at one of the ends thereof means for the mechanical traction of the fabric and joint means for the hydraulic traction thereof.

5 Claims, 6 Drawing Figures

APPARATUS FOR THE WET TREATMENT OF FABRICS

FIELD OF THE INVENTION

The present invention relates to an improved apparatus for the wet treatment of fabrics wherein the fabric is driven in rope form through an enclosed, pressurised or unpressurised vessel. The fabric follows a fast outgoing path through a transport duct and a further slow return path through a storage chamber which contains at any time the major portion of the fabric rope being treated and which is constructed in such a way that the portion of cloth stored in said chamber is kept impregnated with a minimum amount of liquor, with a view to being able to work with a low liquor ratio.

DESCRIPTION OF THE PRIOR ART

In the prior art there are known several machines for the wet treatment of fabric in rope form with high or medium (normal) liquor ratios, in which the fabric is driven along by a hydraulic traction means constituted only by a jet means fed with the liquor itself, which may be complemented with mechanical traction means, such as a winch or an endless belt, either in open vessels or in closed vessels adapted for pressurised operation.

There are also known machines in which the fabric movement is effected by a hydraulic traction means constituted by an overflow means fed with the liquor itself, in which case the hydraulic traction is complemented by mechanical traction as in the previous case.

On the other hand, the present applicant developed apparatus wherein the fabric movement is effected by the used of a mixed hydraulic traction means formed, on the one hand, by an overflow means and, on the other hand, by a jet means. These are completely independent and are complemented by a mechanical traction means comprising a winch, either in an open vessel or in a closed vessel for pressurised operation.

Outstanding among the apparatus in which the fabric is driven through the apparatus only with the aid of a jet are those disclosed in U.S. Pat. No. 2,978,291 (Fabringer-Burlington Industries Inc.), C.S.P. No. 318,087 (Gaston County Dyeing Machine Co.) and 3,771,337 (Trullas-Argelich).

Among the apparatus wherein the fabric is driven through the apparatus with the aid of a jet and a winch or endless belt, are those disclosed in U.S. Pat. Nos. 3,587,256 (Alvar-Avesta Jernwerks Aktiebolag) and 3,952,558 (Sven et al. Avesta Jernwerks Aktiebolag), French Pat. Nos. 72.09.648 (Platt) and 74.09.230 (Thies) and those built by the Italian firm MCS under the name of "JET-MR", by Pegg under the name of "FABLO", by Leopoldo Pozzi under the name of "POZZI-FLOW", by Then under the name of "THEN-ECONOMY-FLOW", by Thies under the name of "R-JET" and by Scholl under the name of "COMPACT".

Among the apparatus wherein the fabric is driven through the apparatus with the aid of an overflow means and a winch or the like, there are those disclosed in Spanish Pat. No. 402.434 (Argelich), French Pat. Nos. 72.41.814 (Argelich) and 2,011,982 (Sakai) and U.S. Pat. No. 3,782,138 (Kawasaki).

Finally, among the apparatus wherein the fabric is driven through the apparatus with a completely independent overflow, jet and winch, are those disclosed in Spanish Pat. Nos. 424,689 and 425,022 (Argelich) and U.S. Pat. No. 3,949,580 (Trullas-Argelich).

The improved apparatus of this invention comprises distinguishing features over the prior art apparatus listed above, particularly with respect to the special construction of the storage chamber, for obtaining a low liquor ratio, and of the overflow and jet devices, to obtain a compact monobloc arrangement, allowing a compact, high capacity apparatus to be obtained.

SUMMARY OF THE INVENTION

The object of the invention is to provide an apparatus of the type indicated in which there are disposed in combination a circuit for the fabric and a further circuit for the treatment liquor, wherein the fabric circuit is constituted by the combination of:

(a) a storage chamber for the major portion of the fabric rope, through which the fabric is caused to pass slowly, substantially submerged in the liquor, which chamber is of tubular construction and substantially circular in a vertical plane;

(b) an upper chamber or zone corresponding to one end of the storage chamber, containing means for mechanical traction of the fabric and combined means for mixed hydraulic traction of said fabric; said means for the mechanical traction of the fabric being constituted by a winch; and said combined means for the mixed hydraulic traction of the fabric comprising an overflow means and a jet means;

(c) a substantially horizontal duct associating the said upper zone from the jet means outlet with the other end of the storage chamber;

whereas the liquor circuit comprises a pump means associating at least one lower point of the storage chamber with the combined means for mixed hydraulic traction of the fabric, through a filter and a steam operated heat exchanger.

A further object of the invention is to provide the combined means for the mixed hydraulic drive of the fabric grouped in a single body, having an overflow means followed immediately by a jet means.

Yet a further object of the invention is to provide the combined means for the mixed hydraulic traction of the fabric formed by an overflow chamber in which there is an annular chamber having in its center passage, in an order determined by the direction of circulation of the fabric rope, a funnel means acting as overflow extending into a tubular peripheral apron portion, opposite to and spaced at a constant peripheral distance from a flared, tubular baffle type body having a transverse dimension greater than that of said tubular portion, which it surrounds with a certain degree of clearance determining a peripheral jet opening, through which there is injected inwardly under pressure the treatment liquor introduced into said annular chamber, which liquor mixes with the liquor coming in from overflowing of the overflow chamber level through the upper face of said annular chamber.

A further object of the invention is to make the flowrate of the overflow means adjustable independently of the flowrate of the jet means.

Yet a further object of the invention is to provide for the flowrate of the overflow means to be regulated in terms of the flowrate of the jet means with a view to filling the vacuum caused by the suction, by the Venturi effect, on the upper face of the annular chamber so as to prevent the aspiration of air and subsequent emulsifying thereof with the treatment liquor which would cause an undesirable foam in the fabric treatment.

A further final object of the invention is to locate the filter between the bottom of the storage chamber and the pump means in the treatment liquor circuit vertically at a level allowing it to be cleaned without draining the treatment liquor circuit.

BRIEF DESCRIPTION OF THE DRAWINGS

Other objects and features of the invention will be disclosed in detail in the following description, taken with the accompanying illustrative drawings in which.

DETAILED DESCRIPTION OF THE INVENTION

Figure 1:
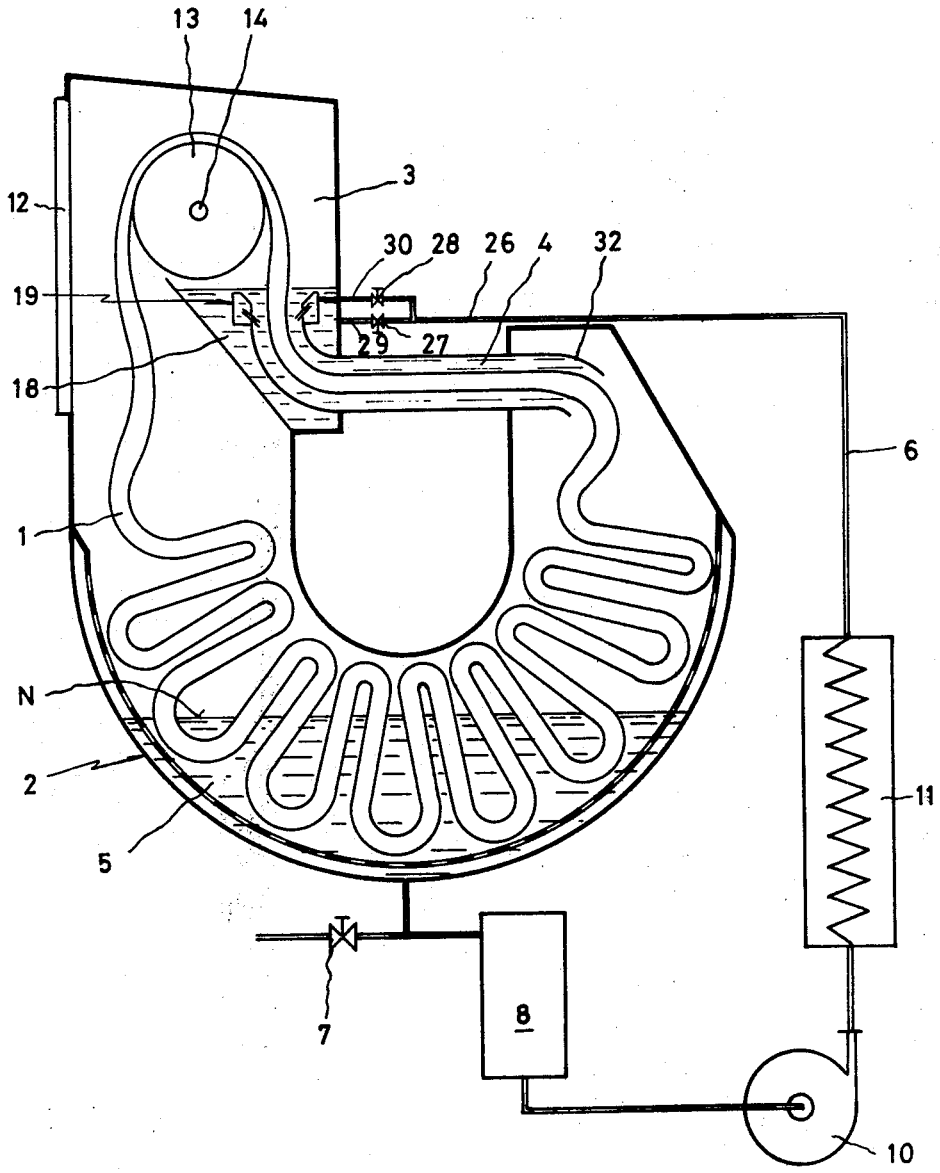
FIG. 1 is a schematic elevation view, in longitudinal section, of an improved apparatus according to the invention, adapted for non-pressurised operation.
Figure 2:
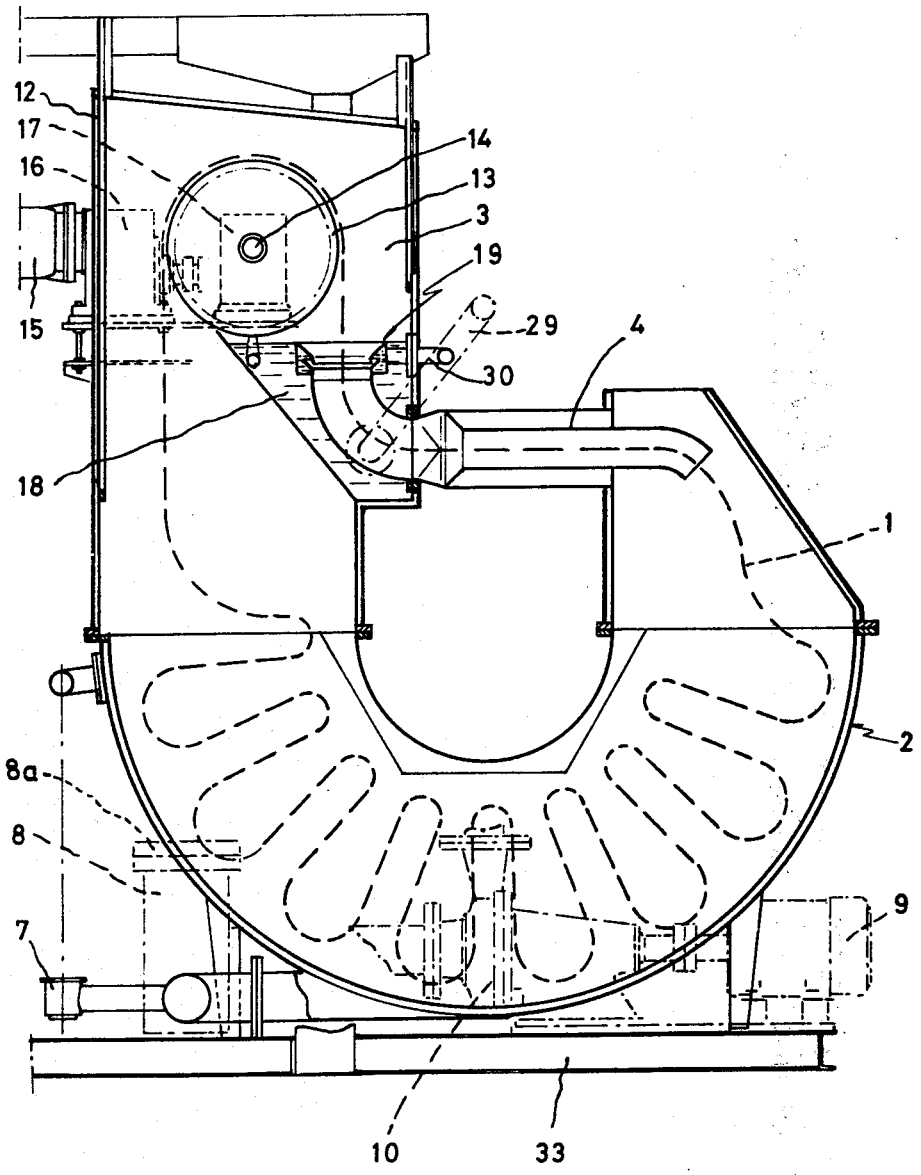
FIG. 2 is an elevation view in longitudinal section, of an apparatus according to the invention.
Figure 3:
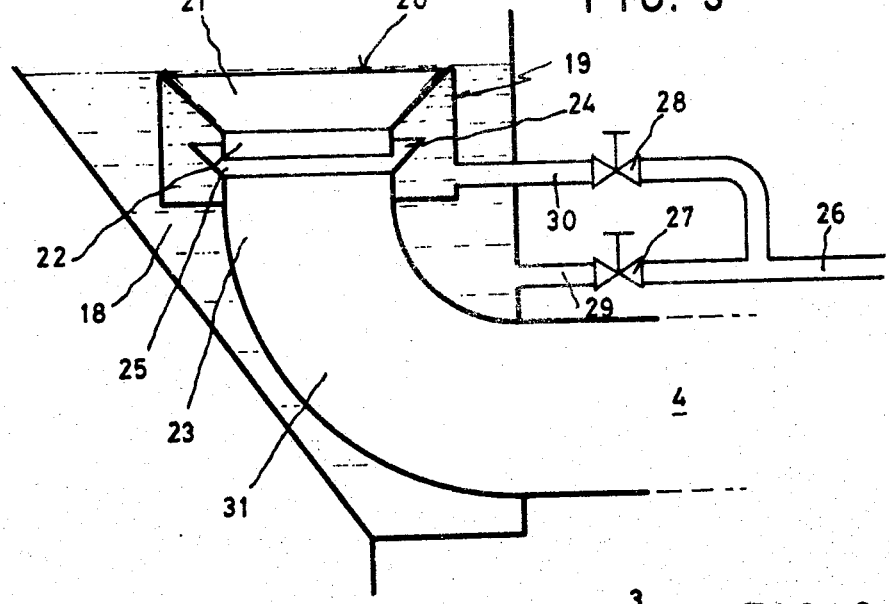
FIG. 3 is a detail in section of the mixed overflow and jet means.

Generally speaking, according to FIG. 1, the apparatus of the invention comprises a circuit for the circulation of a fabric 1 in the form of an endless rope, formed by a storage chamber 2 of curved tubular semicircular construction in the vertical plane, by an upper chamber 3 corresponding to one end of the chamber 2 and by a substantially horizontal transport duct 4 arranged between the upper chamber 3 and the other end of the chamber 2. A circuit for the treatment liquor 5 comprises a duct 6, having a discharge valve 7, associating the bottom of the chamber 2 with the upper chamber 3, through a vertically extending filter 8, a means comprising a motor 9 and a pump 10 and a heat exchanger 11.

The treatment liquor 5 is held at a level N in the chamber 2, said level being adjustable by the liquor circuit. The filter 8 comprises a vertical chamber, having a cover 8a, wherein the filter medium is contained. Said filter 8 is disposed vertically, its upper edge being at a higher level than level N so that the filter may be cleaned without having to drain the treatment liquor circuit. The upper chamber 3 is provided with a side cover 12 and houses a winch 13 wrapped by the fabric 1. The winch 13 may rotate freely or have its shaft 14 coupled to a group formed by a motor 15, variator 16 and a speed reducer 17, without excluding other variable speed units such as D.C. motors and hydraulic motors.

Within said upper chamber 3 there is an overflow chamber 18 provided with an annular chamber 19, illustrated in the drawings as being rectangular in plan view, said annular chamber 19 having at its top face 20 a funnel means 21 acting as overflow, of inverted truncated pyramid shape and having a tubular, peripheral apron portion 22. Said tubular portion 22 is opposite to and spaced at a constant peripheral distance from a rectangular duct 23 having a flared mouth 24, as a baffle, of such dimensions as to spacedly surround the tubular portion 22 so as to produce an exit 25, disposed as a jet means, for the treatment liquor reaching said annular chamber 19. The treatment liquor is fed through the line 26 to the valves 27 and 28 to feed the overflow chamber 18 and annular chamber 19, via lines 29 and 30 respectively. Duct 23 is extended into a curved portion 31 so as, by way of a section modifying coupling, to continue substantially horizontally in the transport duct 4 of circular section. This terminates in a curved portion directed towards the storage chamber at the opposite end thereof to the said upper chamber 3.

The apparatus is located on a bedplate 33 having a frame 34 and which is provided also with accessories such as a kettle 35 for preparing the liquors, with ducts 36 and 37 towards the liquor circuit. The storage chamber 2 has an overflow 38 for excess liquor, for example in continuous washing processes.

In the present apparatus, the fabric 1 circulates under the effect of the thrust received in the annular chamber 19, without prejudice to the fact that the winch 13, which is power driven, may drive along the fabric wrapped around its periphery. The annular chamber 19 also fills the depression created therein by the Venturi effect that the jet means may create, acting as a hydraulic seal to prevent the liquor from emulsifying with the air and the consequent formation of undesirable foam which is harmful to the treatment. The peripheral jet means 25 located under the overflow means 20 is particularly useful for centering the fabric 1 on its passage through the rectangular duct 23 and through the transport duct 4, as well as for contributing to driving the fabric 1 along through the apparatus.

Figure 6:
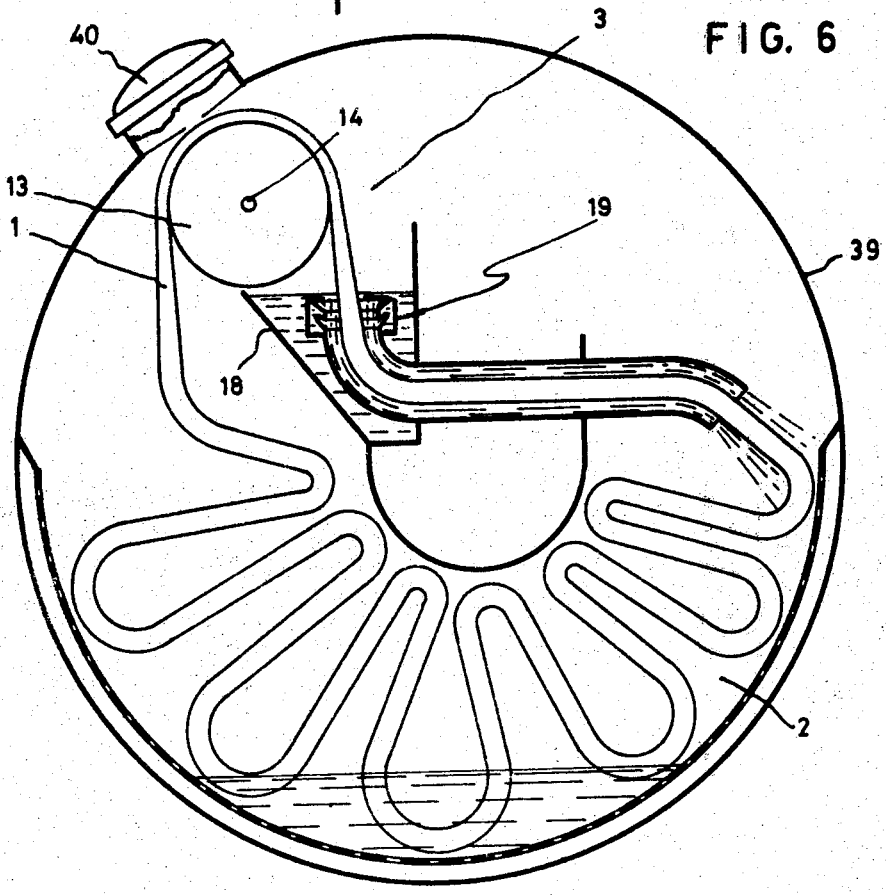
FIG. 6 is a schematic view of an apparatus according to the invention, adapted for pressurised operation.
Figure 4:
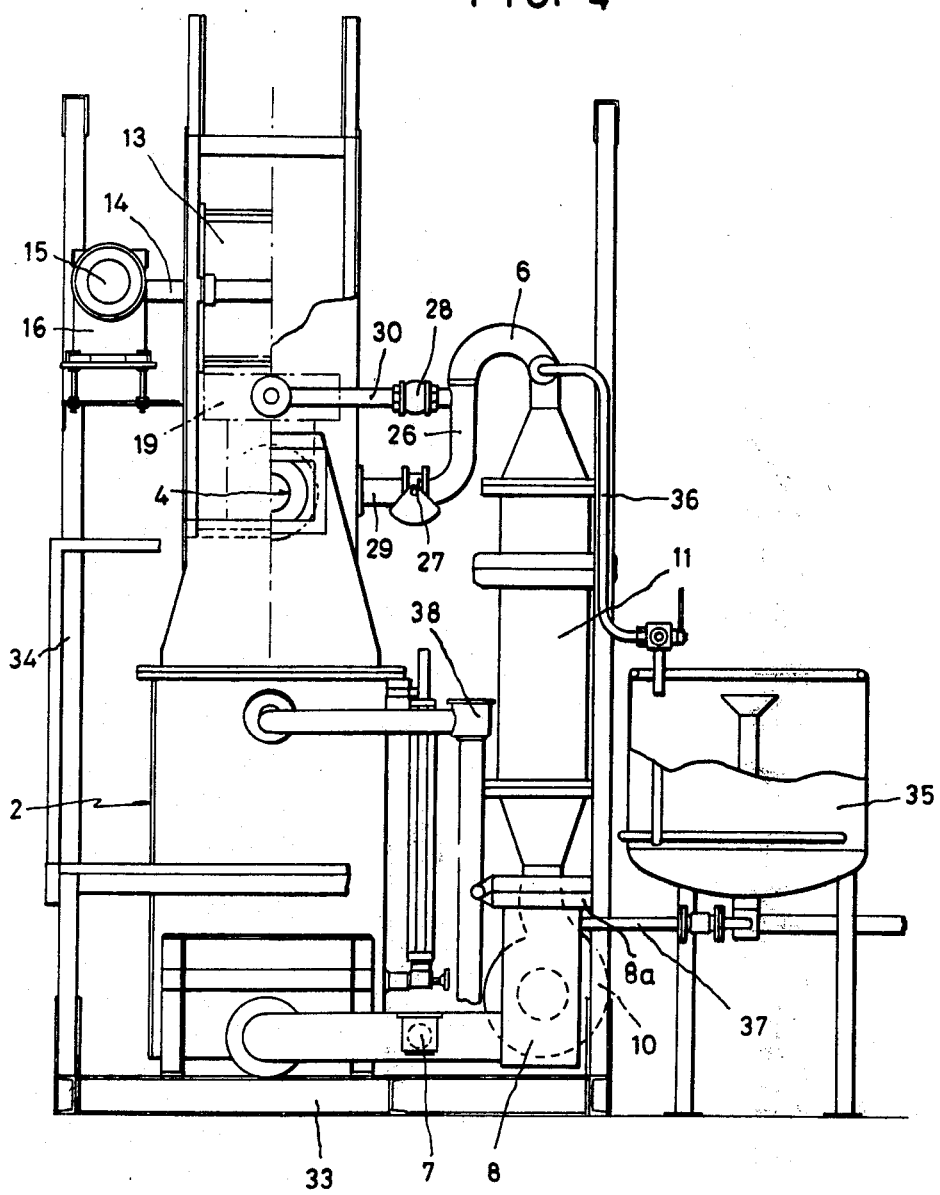
FIG. 4 is a front elevation view of the same apparatus.
Figure 5:
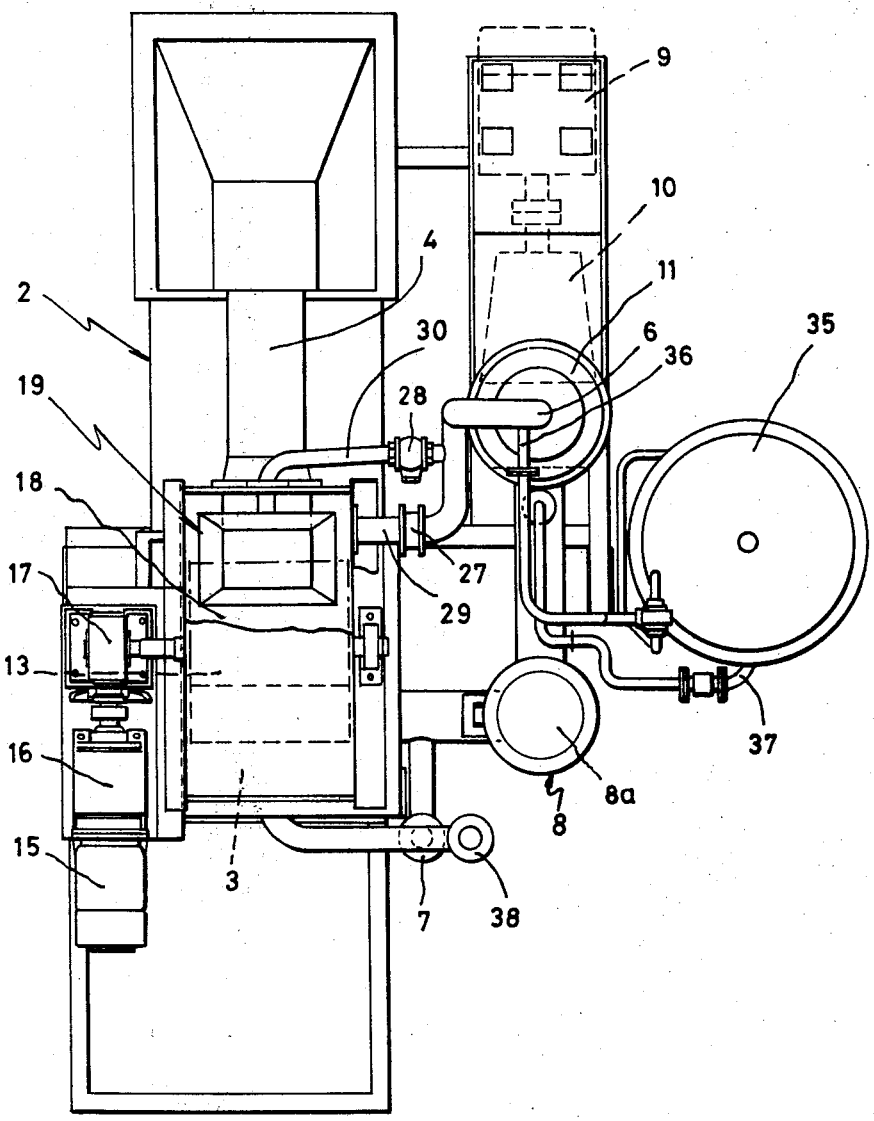
FIG. 5 is a plan view of the apparatus.

As shown in FIG. 6, this apparatus may be mounted in a cylindrical vessel 39 which is pressure resistent and provided with a loading door 40 having an airtight seal so as to be able to operate at high pressures.

In all cases, this apparatus may be built according to a system of modules allowing several units to be joined for individual or joint operation, providing a wide range of flexibility and production, since less units may operate whilst maintaining the low liquor ratio.

What I claim is:

1. In apparatus for the wet treatment of fabrics, of the type in which the fabric is driven in rope form through an enclosed, pressurised or unpressurised vessel, in a fast outgoing path through a transport duct and a further slow return path through a storage chamber which contains at any time the major portion of the fabric rope being treated and in which there are in combination a circuit for the fabric and a further circuit for the treatment liquor, the improvement comprising the combination of:

(a) a storage chamber of tubular construction having a generally U shape with a semicircular center section and first and second vertical arms;

(b) winch means positioned within a first one of said vertical arms for providing mechanical traction for the fabric;

(c) combined means for the mixed hydraulic traction of the fabric positioned within said first one of said vertical arms, said combined means comprising overflow means and jet means, said combined means being positioned above the level of liquor in said storage chamber sufficiently high that transfer of the fabric through the combined means is effected by the overflow of the liquor;

(d) a duct connecting the outlet of said jet means with said second vertical arm of said storage chamber, said duct having a substantially horizontal portion between said first and second vertical arms and having an elbow portion connecting said outlet of said jet means with said substantially horizontal portion; and (e) a bath circuit comprising a pump and a filter, the inlet of said pump being coupled to the lowest point of said storage chamber through said filter and the outlet of said pump being coupled to said combined means for hydraulic traction, said filter having a removable lid, and said filter being positioned vertically with said removable lid being above the level of liquor in said storage chamber, said level of liquor being sufficiently low that the fabric will not float in said liquor.

2. The apparatus of claim 1, wherein the combined means for the mixed hydraulic traction of the fabric is grouped in a single body, having said overflow means followed immediately by said jet means.

3. The apparatus of claim 2, wherein the combined means for the mixed hydraulic traction of the fabric comprises:

an overflow chamber having an annular chamber forming a center passage in said overflow chamber;

funnel means having a tubular peripheral apron portion, said funnel means acting as overflow means for liquor in said overflow chamber;

a flared tubular baffle-type body having a transverse dimension greater than that of said tubular peripheral apron portion of said funnel means, said funnel means being positioned opposite to and spaced at a constant distance from said baffunder pressure through said jet opening, the liquor emerging from the jet opening mixing with the liquor flowing through said funnel means.

4. The apparatus of claim 3 comprising means for adjusting the flowrate of the overflow means independently of the flowrate of the jet means.

5. The apparatus of claim 4, wherein said adjusting means is set such that the flowrate of the overflow means is regulated in terms of the flowrate of the jet means to fill the vacuum caused by the suction, by the Venturi effect, on the upper face of the annular chamber so as to prevent the aspiration of air and subsequent emulsifying thereof with the treatment liquor.

* * * * *